United States Patent [19]

Rein

[11] Patent Number: 4,952,085

[45] Date of Patent: Aug. 28, 1990

[54] PRINTER FOR GENERATING IMAGES WITH HIGH CONTRAST GRAY AND COLOR TONE GRADATIONS

[75] Inventor: Wolf-Heider Rein, Pforzheim, Fed. Rep. of Germany

[73] Assignee: Alcatel N.V., Netherlands

[21] Appl. No.: 318,276

[22] Filed: Mar. 3, 1989

[30] Foreign Application Priority Data

Mar. 3, 1988 [DE] Fed. Rep. of Germany ..... 3806935

[51] Int. Cl.[5] ..... B41J 2/385

[52] U.S. Cl. ..... 400/120; 400/121; 346/76 PH

[58] Field of Search ..... 400/120, 121; 346/76 PH; 358/298

[56] References Cited

U.S. PATENT DOCUMENTS

| | | | |
|---|---|---|---|
| 4,268,179 | 5/1981 | Long et al. | 346/76 PH X |
| 4,536,771 | 8/1985 | Tanaka | 346/76 PH |
| 4,547,784 | 10/1985 | Erlichman | 400/120 X |
| 4,768,042 | 8/1988 | Zama | 358/298 X |
| 4,777,536 | 10/1988 | Kato | 358/298 |
| 4,809,021 | 2/1989 | Check | 346/76 PH X |

FOREIGN PATENT DOCUMENTS 3309328 9/1983 Fed. Rep. of Germany .

OTHER PUBLICATIONS

Erhard D. Stiebner v.a., Drucktechnik heute, 1985, Verl. F. Bruckman KG., München.

*Primary Examiner*—Edgar S. Burr
*Assistant Examiner*—Joseph R. Keating
*Attorney, Agent, or Firm*—Spencer & Frank

[57] ABSTRACT

The invention relates to a printer, preferably a thermal printer, equipped with a line-width printing head including a plurality of closely spaced printing elements. To permit high contrast gray tone gradation in a dot matrix image, the invention provides that the printing elements having odd and even ordinal numbers are combined into respective energization groups. The two groups can be energized alternatingly at the spacing of one matrix line. Thus, the distance between adjacent image dots is twice as large as the distance between the printing elements. The printing elements can be energized by different amounts of energy in four successive time periods during the advancement of the sheet of paper by one matrix line. By way of the selection of individual periods and their combination, the heating elements can be excited at thirteen different energy levels. In this way, image dots can be produced from the size of a barely visible dot to twice the area of a printing element.

6 Claims, 3 Drawing Sheets

PRINTER FOR GENERATING IMAGES WITH HIGH CONTRAST GRAY AND COLOR TONE GRADATIONS

CROSS REFERENCE TO RELATED APPLICATION

This application claims the priority of application Ser. No. P 38 06 935.0, filed Mar. 3, 1988, in the Federal Republic of Germany, the subject matter of which is incorporated herein by reference.

BACKGROUND OF THE INVENTION

The present invention relates to a printer having a paper transporting device and a printing head which is equipped with a plurality of closely spaced, electrically energizable printing elements arranged in a row, wherein the printing elements having odd and even ordinal numbers, or vice versa, are alternatingly energizable with variable energy corresponding to the gray values of the image information so as to represent the gray values by different size image dots.

Such a printer, in the form of a thermal printer, is disclosed in DE-A No. 3,309,328. For printing of a matrix line, the heating elements of the thermal printing head are energized in two consecutive time periods, with adjacent heating elements never being traversed simultaneously by heating current. In this way it is prevented that adjacent image dots run into one another due to thermal crosstalk. By varying the heating currents, the size of the image dots can be varied. The range over which the image dot size can be varied is limited by the distance between the heating elements. In presently customary thermal printing heads including an arrangement of 12 to 16 heating elements per millimeter, the possible variation in image dot size is relatively small with respect to high contrast gray and color tone gradations.

The principle of dot-matrix printing is sufficiently known from the printing art. There, too, different areal expanses of the matrix dots which are gradated as to their tone value, simulate a half-tone effect. This is based on the fact that the human eye is unable to discern the individual matrix dots in their small size and density. This limited resolution capability of the human eye also forms the basis for the matrix sizes employed in the printing art, for example, sixty lines per centimeter, i. e. six lines per millimeter, for a higher standard quality, with the matrix dots being equidistantly arranged in the direction of the line (Erhard D. Stiebner et al, "Drucktechnik heute" [Printing Technology Today], 1985, published by Verlag F. Bruckmann KG, Munich, ISBN 3-7654-1951-6, page 84).

SUMMARY OF THE INVENTION

It is the object of the invention to provide a printer of the above-mentioned type which, with sufficiently high resolution, permits high contrast gray and color tone gradations.

The objects and accomplishments of the invention are achieved in the context of the printer described above wherein the paper transporting device advances paper to be printed by printing head by the spacing of one matrix line between the alternating energization of odd numbered and even numbered printing elements, and each printing element receives, at a maximum, so much energy that the area of the printed image dot becomes approximately twice as large as the area of a printing element.

The advantages realized by the invention are, in particular, that the matrix size given by the distance between the printing elements, if a line-width printing head is employed as it is customary in the trade, is doubled without noticeably worsening resolution. The thus doubled distance between individual image dots permits a corresponding variation of the image dot area up to twice the size of a printing element. The printing elements receive their respective energy in several levels of different amounts of energy. This is preferably effected during the time the record carrier advances by one matrix line. The principle can be applied for all printers in which the size of the image dot can be influenced by the amount of energy supplied to the printing elements.

DETAILED DESCRIPTION OF THE PREFERRED EMBODIMENT

Figure 1:
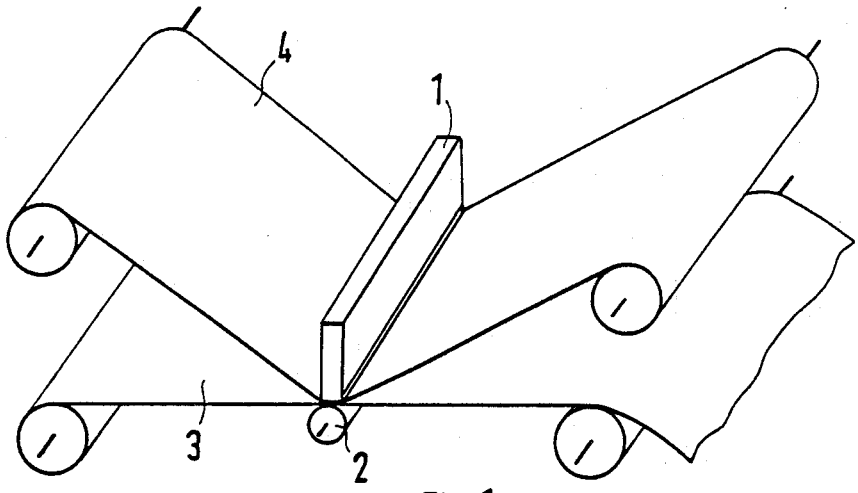
FIG. 1 is a schematic, perspective representation of a thermal printer including a line-width thermal printing head and a corresponding thermal ink ribbon.

FIG. 1, a basic illustration in perspective and limited to the significant features, shows a known thermal printer including a line-width thermal printing head 1. At its frontal face facing a platen 2, thermal printing head 1 is provided with a plurality of closely spaced heating elements arranged in a row over the printing width. In a known manner, these heating elements can be individually connected to a current source by way of electronic actuation circuits. The quantity of energy supplied to the individual heating elements is variable to correspond to the desired image dot size, as described, for example, in DE-A No. 3,309,328. A sheet of paper 3 and a line-width thermal ink ribbon 4 pass between platen 2 and thermal printing head 1. During printing, both are moved synchronously and continuously between printing head 1 and platen 2. During this passage, thermal ink ribbon 4 transfers its color coating to sheet of paper 3 at the locations heated by the heating elements.

Figure 2:
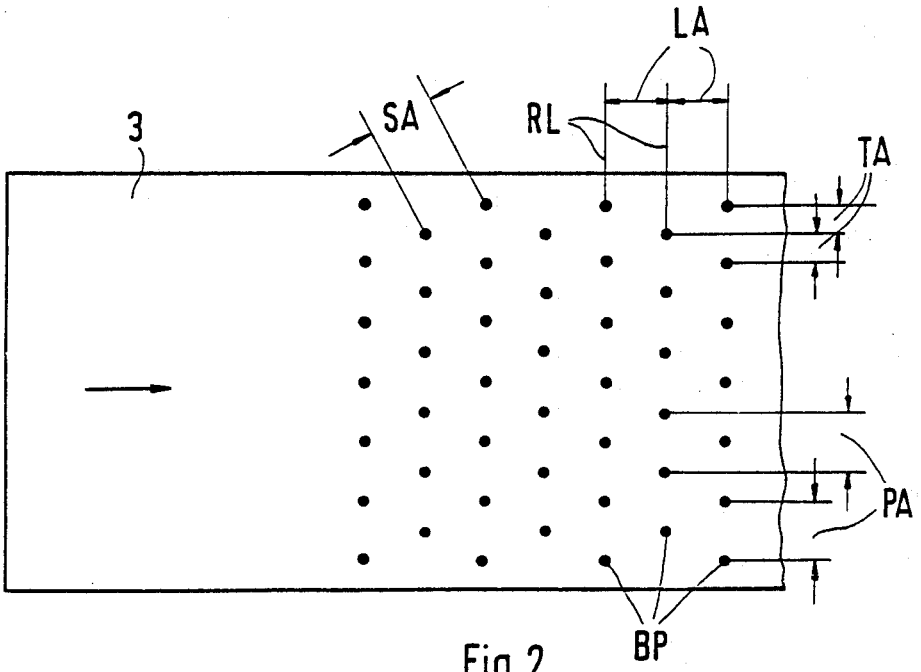
FIG. 2 shows a sheet of paper, not to scale, imprinted with small image dots by the printer according to the invention shown in FIG. 1.

FIG. 2 shows a sheet of paper 3 which has been imprinted in the direction of the arrow and in the manner described above with small image dots BP arranged in a matrix pattern. Image dots BP are variable in size so as to produce different gray tones. For reasons of clarity, the size and mutual spacing of image dots BP has been greatly enlarged relative to the dimensions of sheet of paper 3. The image dot matrix pattern is based on a distance TA between the heating elements of thermal printing head 1; doubling this distance results in the distance PA between image dots BP in one matrix line RL. As can be seen in FIG. 2, image dots BP are distributed substantially uniformly over the surface of sheet of paper 3 at relatively large distances from one another. This is accomplished in that, during printing of all odd numbered matrix lines RL, only the heating elements having an odd ordinal number can be energized, while during printing of all even numbered matrix lines RL, only the heating elements having an even ordinal number can be energized. Optimum distribution of image dots BP over the area is realized if the diagonal distance SA between two adjacent image dots BP belonging to adjacent matrix lines RL is equal to the distance PA between the image dots BP of one matrix line RL.

Due to the alternating distribution of possible image dots BP to two matrix lines RL, the maximum image dot area, which in the past had been limited to the size of a heating element, is doubled. Although this reduces image resolution by half, this—as explained above—has no noticeable effect if a thermal printing head is employed which has, for example, 12 heating elements per millimeter, as it is customary in the trade. In contrast thereto, the area available for each image dot permits optimum gray tone gradations from a barely visible dot to twice the area of a heating element.

In accordance with the gray scale according to DIN [German Industrial Standard] 16543 customary in the printing art, thirteen uniformly gradated energy values are available for selection for the heating elements to be energized. This is made possible in that the time available for energization of the heating elements in one matrix line is divided into four time periods. Each time period represents a different energy value, e.g. in the form of current pulses of different lengths. The ratio of the energy of the pulses is 6:5:4:3. By combining the four pulses, this scheme makes available thirteen uniformly stepped value levels from 3/15 to 15/15 spaced at 1/15. Moreover, the distribution of the respective energy supplied is relatively uniform over the total excitation period.

Figure 3:
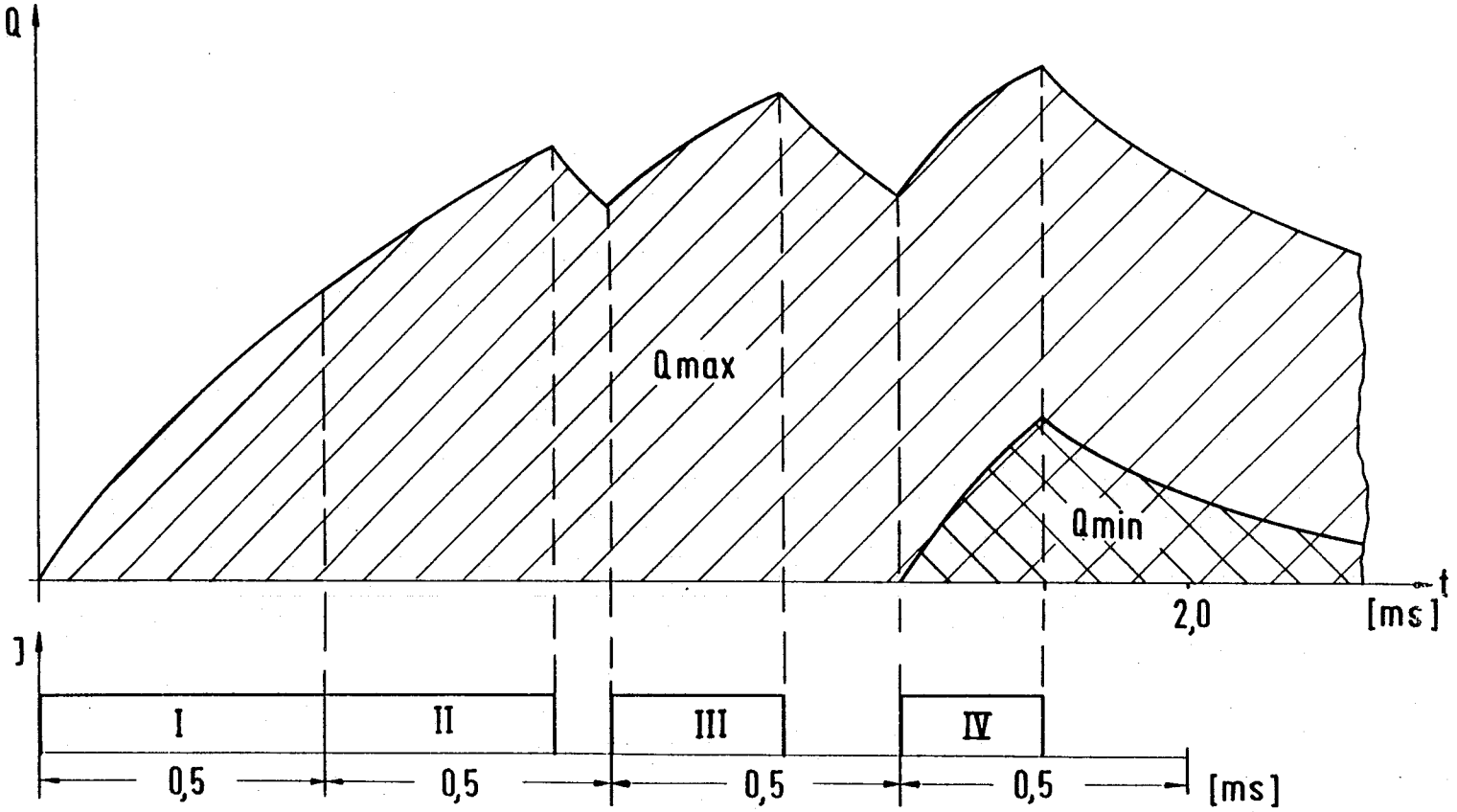
FIG. 3 is a diagram showing the greatest and smallest quantity of heat emitted by a heating element as a function of its energization.

FIG. 3 shows, in the form of a diagram, the quantity of heat Q put out by one heating element as a function of its excitation. Below the diagram, the four pulses I to IV are shown which are stepped in a ratio of 6:5:4:3 over an excitation period of 2 ms and are available individually and in combination, each assigned a time period of 0.5 ms. Within the time of 2 ms available for energization of the heating elements, the thermal printing head is charged four times in succession by the associated electronic system, each time offering pulses I through IV in succession. A selection circuit as it is customary in thermal printers, charges the heating elements, according to the detected gray value of a sample, with no pulse, one pulse or a combination of the four pulses I to IV. To illustrate the above, the diagram of FIG. 3 shows two curves whose enclosed areas represent the quantities of heat $Q_{min}$ (cross hatched) and $Q_{max}$ (hatched), respectively, emitted by a heating element if the latter is excited only by pulse IV or by a combination of all pulses I to IV, respectively. Between these two values lie the remaining values in uniform gradation.

Figure 4:
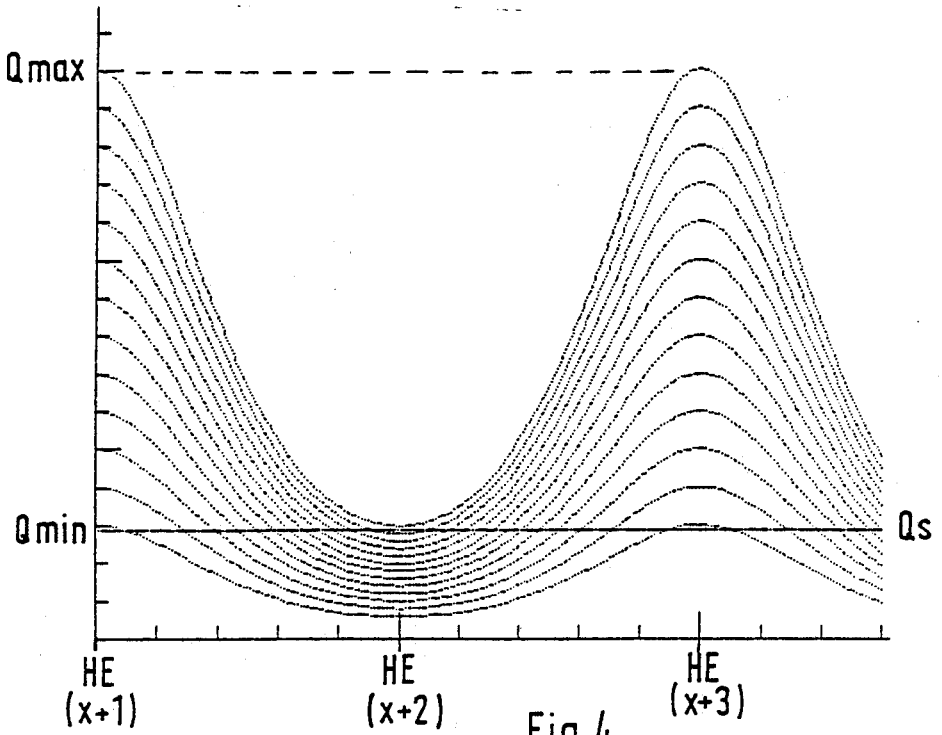
FIG. 4 is a diagram of the heat distribution in the thermal ink ribbon of the printer of FIG. 1 between the lowest and the highest quantity of heat supplied.
Figure 5:
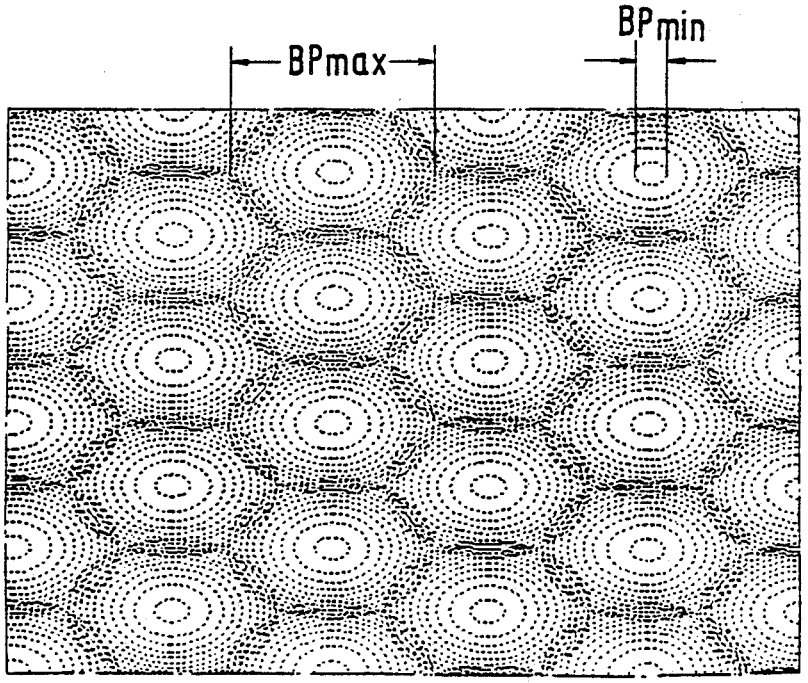
FIG. 5 is an enlarged sectional view of the sheet of paper according to FIG. 2 with a schematic representation of the image dots in ring form to show the change in the image dot areas when small and large quantities of heat are supplied.

The quantity of heat Q emitted by each individual heating element determines the size of the respective image dot BP from a barely visible dot to twice the dimension of a heating element, as demonstrated by the illustrations in FIGS. 4 and 5.

FIG. 4 shows, in a group of curves, the distribution of heat between two identically excited heating elements HE (x+1) and HE (x+3) having an odd ordinal number. FIG. 5 is an enlarged sectional view of the sheet of paper 3 of FIG. 2. The respective image dots BP are represented schematically by temperature rings which indicate the change in the image dot area $BP_{mim}$ and $BP_{max}$, respectively, under small or large quantities of heat. The heat curves of FIG. 4 correspond to the thirteen possible energy levels with which heating elements HE can be energized. Line $Q_s$ indicates the quantity of heat at which the ink layer is released from the carrier of thermal ink ribbon 4 (FIG. 1). With increasing heat quantity Q, the surface area of ink ribbon 4 is heated to and thus the size of the image dot or image dots BP continues to increase until, according to FIG. 5, at a heat quantity of $Q_{max}$, adjacent image dot regions contact one another or even partially overlap one another. The oval shape of image dots BP in FIG. 5 is caused, on the one hand, by the preferably rectangular dimensions of the heating elements but also by the continuous advancement of sheet of paper 3 during the printing process.

The above described principle can be employed for all printers in which variable energy values are made available for the generation of the image dots. This is applicable, for example, for the actuation of the light valves of an electro-optical printer.

It will be understood that the above description of the present invention is susceptible to various modifications, changes and adaptations, and the same are intended to be comprehended within the meaning and range of equivalents of the appended claims.

What is claimed is:

1. A printer for printing a matrix of image dots comprising a paper transporting device and a printing head having a plurality of closely spaced, electrically energizable printing elements, the printing elements being arranged in a row of odd and even numbered printing elements, means for alternatingly energizing the printing elements having an odd ordinal number and the printing elements having an even ordinal number with variable energy corresponding to the varying gray values of an image information so as to represent the varying gray values by different size image dots, wherein the paper transporting device advances paper to be printed by the printing head by the spacing of one matrix line between the alternating energization of the odd numbered and the even numbered printing elements, and each printing element receives, at a maximum, so much energy that the area of the printed image dot becomes approximately twice as large as the area of a printing element.

2. A printer as defined in claim 1, wherein the amount of paper advance is selected so that the diagonal distance between the image dots produced by adjacent printing elements in successive matrix lines is equal to twice the distance between the adjacent printing elements.

3. A printer as defined in claim 1, wherein the printing elements receive their energy in a plurality of successive time periods.

4. A printer as defined in claim 3, wherein the energy associated with each individual time period is of different magnitude and the individual time periods can be combined with one another to obtain a greater number of different energy magnitudes.

5. A printer as defined in claim 1, wherein the paper transporting device provides a continuous paper advance, and the energy is alternatingly supplied during the advancement of the paper by one matrix line to the odd numbered printing elements and the even numbered printing elements.

6. A printer as defined in claim 1, wherein the printer is a thermal printer and the printing elements are electrically energizable heating elements.

* * * * *